US011440764B2

(12) United States Patent
Sekiyama

(10) Patent No.: US 11,440,764 B2
(45) Date of Patent: Sep. 13, 2022

(54) SHEET DISCHARGE APPARATUS AND IMAGE FORMING APPARATUS

(71) Applicant: CANON KABUSHIKI KAISHA, Tokyo (JP)

(72) Inventor: Junichi Sekiyama, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/379,057

(22) Filed: Jul. 19, 2021

(65) Prior Publication Data

US 2022/0033212 A1 Feb. 3, 2022

(30) Foreign Application Priority Data

Jul. 30, 2020 (JP) ..... JP2020-129497
May 31, 2021 (JP) ..... JP2021-090931

(51) Int. Cl.
*B65H 29/24* (2006.01)
*B65H 31/02* (2006.01)
*B65H 31/26* (2006.01)

(52) U.S. Cl.
CPC ..... *B65H 31/02* (2013.01); *B65H 29/24* (2013.01); *B65H 29/245* (2013.01); *B65H 29/246* (2013.01); *B65H 29/247* (2013.01); *B65H 31/26* (2013.01)

(58) Field of Classification Search
CPC ..... B65H 31/02; B65H 31/26; B65H 29/24; B65H 29/245; B65H 29/246; B65H 29/247
See application file for complete search history.

(56) References Cited

U.S. PATENT DOCUMENTS 2,645,480 A * 7/1953 Long ..... B65H 29/246 271/207
4,405,125 A * 9/1983 Kulpa ..... B65H 29/246 271/211
4,811,547 A * 3/1989 Raats ..... B65H 29/246 271/211

(Continued)

FOREIGN PATENT DOCUMENTS

DE 19635401 C1 * 12/1997 ..... B65H 29/041
JP H0891672 A 4/1996

(Continued)

*Primary Examiner* — Leslie A Nicholson, III
(74) *Attorney, Agent, or Firm* — Rossi, Kimms & McDowell LLP

(57) ABSTRACT

A sheet discharge apparatus includes a discharge unit configured to discharge a sheet in a discharge direction, a stacking surface configured to stack the sheet discharged by the discharge unit, and a wall including a plurality of hole portions and an abutting part, wherein the plurality of hole portions includes a first hole portion disposed across an extension line along the stacking surface when viewed in a width direction, the first hole portion including a first edge portion and a second edge portion, the first edge portion being positioned on a side of the stacking surface, and wherein, in the vertical direction, an upper end of the first edge portion of the first hole portion is positioned above the extension line, and a lower end of the first edge portion of the first hole portion is positioned below the extension line.

14 Claims, 11 Drawing Sheets

(56) References Cited

U.S. PATENT DOCUMENTS

| | | | | |
|---|---|---|---|---|
| 7,283,776 | B2 * | 10/2007 | Oba | G03G 15/6573 399/304 |
| 8,727,345 | B2 * | 5/2014 | Konno | B65H 29/00 271/211 |
| 8,960,668 | B2 * | 2/2015 | Obuchi | B65H 29/14 271/211 |
| 9,075,377 | B2 * | 7/2015 | Nagasako | B65H 29/14 |
| 9,630,794 | B2 * | 4/2017 | Chiwata | B65H 29/245 |
| 9,758,334 | B1 * | 9/2017 | Herrmann | B65H 29/14 |
| 11,084,679 | B2 * | 8/2021 | Tsuchiya | B65H 31/10 |
| 2019/0382227 | A1 * | 12/2019 | Sakagami | G03G 15/6552 |

FOREIGN PATENT DOCUMENTS

| | | | |
|---|---|---|---|
| JP | 2009102111 | A | 5/2009 |
| JP | 2018144968 | A | 9/2018 |
| JP | 2019055869 | A | 4/2019 |

* cited by examiner

SHEET DISCHARGE APPARATUS AND IMAGE FORMING APPARATUS

BACKGROUND OF THE INVENTION

Field of the Invention

This invention relates to a sheet discharge apparatus to discharge a sheet and an image forming apparatus including this sheet discharge apparatus.

Description of the Related Art

Hitherto, an image forming apparatus discharging a sheet, on which an image has been formed, to a sheet stacking part is suggested (refer to Japanese Patent Laid-Open No. 2018-144968). The sheet stacked on the sheet stacking part slides along a stacking surface of the sheet stacking part, and is aligned in such a manner that a trailing edge of the sheet abuts onto a trailing edge receiving member. When the sheet stacked on the sheet stacking part has not been cooled sufficiently, the sheets sometimes stick to each other by weight of the sheet. Therefore, the image forming apparatus described in Japanese Patent Laid-Open No. 2018-144968 disposes a blower fan generating an air flow in an inside of an apparatus body, and also disposes an orifice for discharging the air flow generated by the blower fan at the trailing edge receiving member.

However, since the orifice for discharging described in Japanese Patent Laid-Open No. 2018-144968 is disposed above a stacking surface of the sheet stacking part, there is a risk that it is not possible to cool the sheet stacked on the stacking surface sufficiently.

SUMMARY OF THE INVENTION

According to one aspect of the present invention, a sheet discharge apparatus includes a discharge unit configured to discharge a sheet in a discharge direction, a stacking surface configured to stack the sheet discharged by the discharge unit, and a wall including a plurality of hole portions and an abutting part against which an upstream edge, in the discharge direction, of the sheet stacked on the stacking surface abuts, the abutting part being disposed upstream of the stacking surface in the discharge direction, wherein the plurality of hole portions includes a first hole portion disposed across an extension line along the stacking surface when viewed in a width direction orthogonal to the discharge direction and a vertical direction, the first hole portion including a first edge portion and a second edge portion opposite to the first edge portion, the first edge portion being positioned on a side of the stacking surface, and wherein, in the vertical direction, an upper end of the first edge portion of the first hole portion is positioned above the extension line, and a lower end of the first edge portion of the first hole portion is positioned below the extension line.

Further features of the present invention will become apparent from the following description of exemplary embodiments with reference to the attached drawings.

DESCRIPTION OF THE EMBODIMENTS

First Embodiment

General Arrangement

First, a first embodiment of this disclosure will be described. As an image forming apparatus, a printer 100 is an electrophotographic laser beam printer forming a monochromic toner image. To be noted, in the following descriptions, a sheet S is a sheet on which the image is formed by the printer 100, and includes, for example, a paper, an OHT (overhead projector transparent) sheet, and the like.

Figure 1:
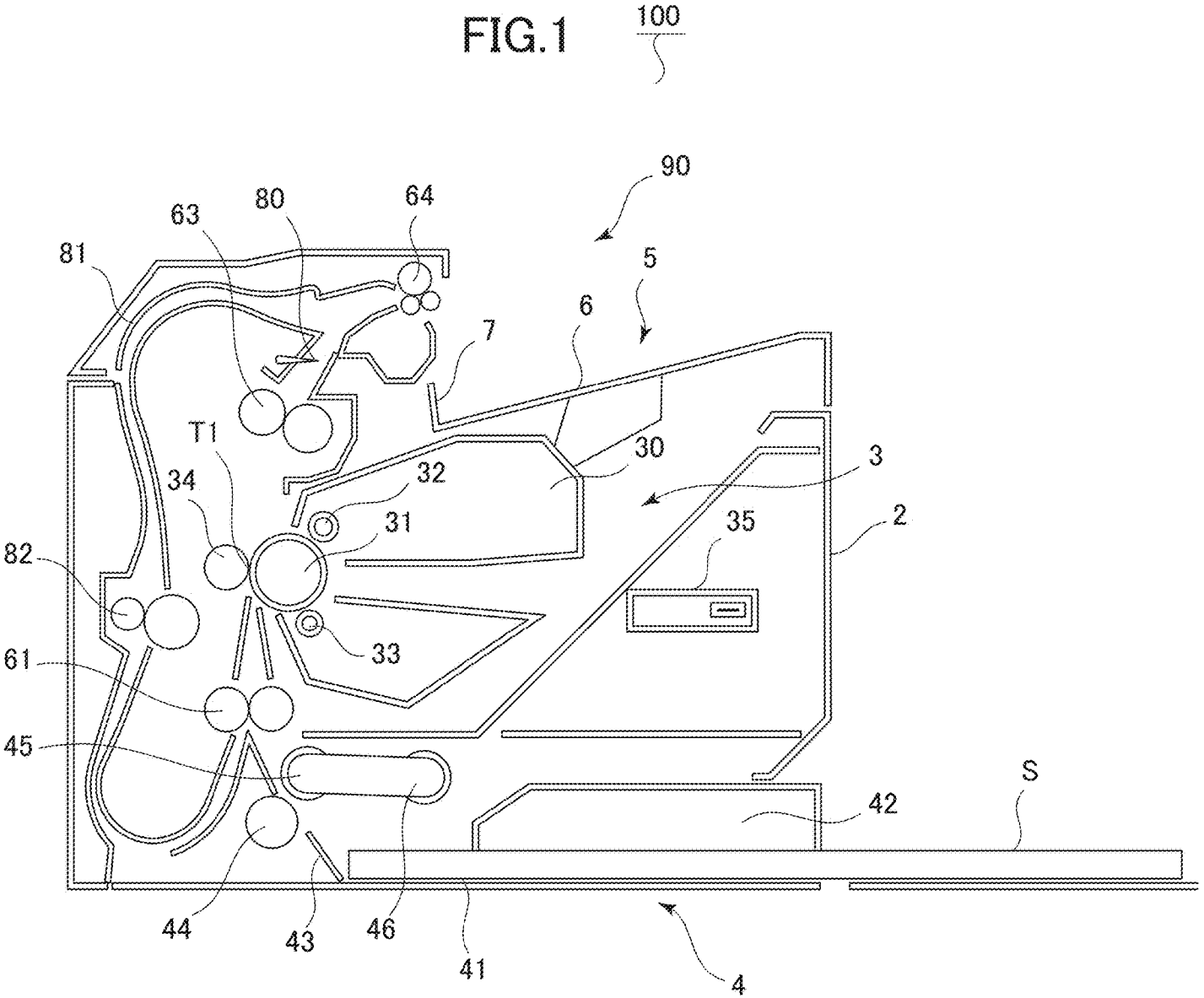
FIG. 1 is a schematic view showing a general arrangement of a printer according to a first embodiment.

The printer 100 includes, as shown in FIG. 1, a sheet feed apparatus 4 feeding a stacked sheet, an image forming unit 3 forming the image on the sheet fed by the sheet feed apparatus 4, and a fixing unit 63 fixing the image transferred onto the sheet. Further, the printer 100 includes a sheet discharge apparatus 90 discharging a discharged sheet to a sheet stacking part 5.

When an image forming job is output to the printer 100, the image forming unit 3 starts an image forming process based on image information input from an external computer and the like coupled to the printer 100. The image forming unit 3 includes a laser scanner 35, a photosensitive drum 31, a charge roller 32, a developing roller 33, and a transfer roller 34. The photosensitive drum 31, the charge roller 32, and the developing roller 33 are collectively put into a cartridge so that it is possible to perform replacement integrally. The photosensitive drum 31 and the transfer roller 34 form a transfer nip portion T1, serving as a transfer portion.

The laser scanner 35 irradiates the photosensitive drum 31 with a laser beam based on the input image information. At this time, the photosensitive drum 31 has been charged by the charge roller 32 beforehand, and an electrostatic latent image is formed on the photosensitive drum 31 by being irradiated with the laser beam. Thereafter, the electrostatic latent image is developed by the developing roller 33, and the monochromic toner image is formed on the photosensitive drum 31.

In parallel with the image forming process described above, the sheet S is fed from the sheet feed apparatus 4. The sheet feed apparatus 4 includes a sheet storing part 41 disposed at a lower portion of an apparatus body 2 of the printer 100, a regulation plate pair 42 regulating both edges of the sheet stored in the sheet storing part 41 in a width direction, and a pickup roller 46. Further, the sheet feed apparatus 4 includes an inclined plane 43 regulating a front edge of the sheet S stored in the sheet storing part 41, a feed roller 45, and a separation roller 44.

When a feed operation of the sheet S is started, the pickup roller 46 comes down, and comes into contact with an upper surface of the sheet S stored in the sheet storing part 41. By rotation of the pickup roller 46 in this state, the sheet S is fed. The fed sheet S is separated into one sheet a time by the feed roller 45 and the separation roller 44, and conveyed by a conveyance roller pair 61.

To be noted, the separation roller 44 is separated from the feed roller 45 when a leading edge of the sheet S reaches the conveyance roller pair 61. Herewith, it is possible to reduce a decrease in a sheet conveyance speed due to back tension of the sheet S and a vibration generated at a passage of the sheet S through a separation nip portion formed by the feed roller 45 and the separation roller 44.

Further, it is acceptable to dispose an intermediate board capable of supporting the sheet and capable of ascending and descending in the sheet storing part 41, and, for example, it is acceptable to lift the intermediate board when the image forming job is input so that the sheet supported by the intermediate board and the pickup roller 46 come into contact with each other. Further, it is possible to apply a torque limiter method and a retard roller method for the separation roller 44, and also acceptable to apply a pad or the like in place of the separation roller 44.

The sheet S passes through the conveyance roller pair 61, and the toner image on the photosensitive drum 31 is transferred to the sheet S at the transfer nip portion T1 by an electrostatic load bias applied to the transfer roller 34. A residual toner remained on the photosensitive drum 31 is collected by a cleaning blade, not shown. The sheet S onto which the toner image has been transferred is provided with heat and pressure by the fixing unit 63, and toner is melted and bonded (fixed). The sheet S passed through the fixing unit 63 is discharged to the sheet stacking part 5 by a discharge roller pair 64, serving as a discharge unit.

Next, a case where the image is formed on both sides of the sheet S will be described. Between the fixing unit 63 and the sheet discharge roller pair 64, a post-fixing sensor 80 is disposed. Based on a detection result which is obtained when the post-fixing sensor 80 detects a trailing edge of the sheet S on which the image has been formed on a first surface, the sheet discharge roller pair 64 rotates in the reverse direction. Herewith, the sheet S is sent into a duplex conveyance path 81 by the discharge roller pair 64.

The sheet S sent into the duplex conveyance path 81 abuts onto a shatter member, not shown, disposed in front of a conveyance roller pair 82. Herewith, a skew of the sheet S is corrected. Then, the sheet S is again guided to the conveyance roller pair 61 by the conveyance roller pair 82. The image is formed on a second surface of the sheet S at the transfer nip portion T1, and the sheet S is discharged to the sheet stacking part 5.

As described above, a path configuration in which, after having conveyed the fed sheet S upwards, the sheet S is discharged in an opposite direction (left to right in FIG. 1) of a sheet feed direction (right to left in FIG. 1) is suitable for miniaturization of the printer 100. However, the path configuration of the printer 100 is not limited to this.

Sheet Discharge Apparatus

Figure 2:
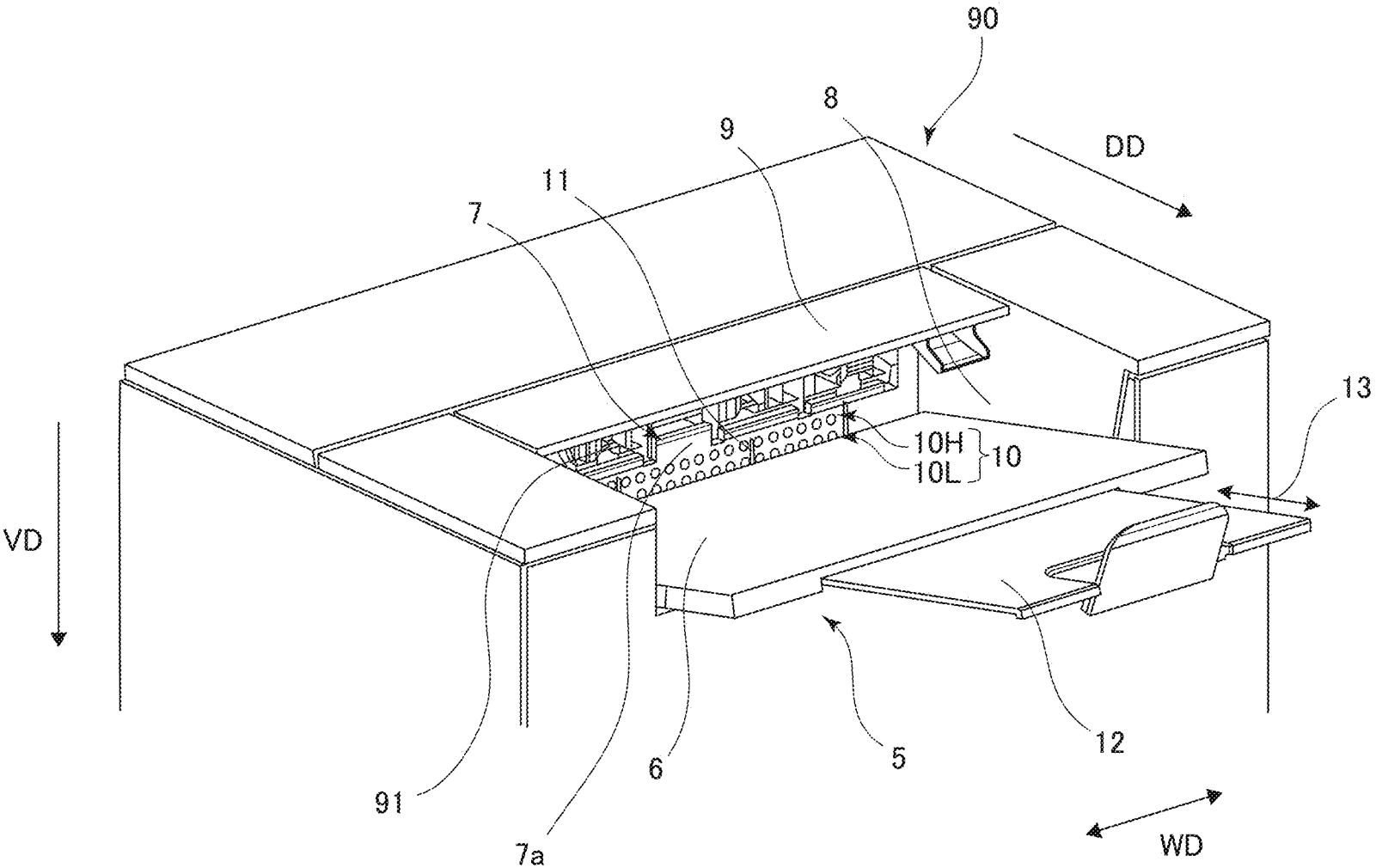
FIG. 2 is a perspective view showing a sheet discharge apparatus.

Next, using FIG. 2, a configuration of a sheet discharge apparatus 90 will be described. The sheet discharge apparatus 90 includes the discharge roller pair 64 (refer to FIG. 1), the sheet stacking part 5, and an eaves cover 9. The sheet stacking part 5 includes a stacking surface 6 on which the sheet S discharged by the discharge roller pair 64 is stacked, an abutting wall part 7, and a side wall part 8.

The abutting wall part 7, serving as a wall, is disposed upstream of the stacking surface 6 in a sheet discharge direction DD. The abutting wall part 7 faces the stacking surface 6, and, when viewed from the stacking surface 6, extends upwards in a vertical direction VD. The abutting wall part 7 extends along the vertical direction VD. It is acceptable that an extending direction of the abutting wall part 7 is parallel to the vertical direction VD or inclined with respect to the vertical direction VD. The side wall parts 8 are disposed on both sides of the stacking surface 6 in a width direction WD. The side wall part 8 is, when viewed from the stacking surface 6, extends upwards in the vertical direction VD. It is acceptable that an extending direction of the side wall part 8 is parallel to the vertical direction VD or inclined with respect to the vertical direction VD. The width direction WD is a direction orthogonal to the sheet discharge direction DD and the vertical direction VD. Further, the width direction WD is parallel to an axial direction of each roller (rotary member) included in the discharge roller pair 64.

The stacking surface 6 inclines downwards toward an upstream side in the sheet discharge direction DD. Therefore, the sheet S discharged by the discharge roller pair 64 slides down toward the abutting wall part 7 along the stacking surface 6. Then, an upstream edge of the sheet S in the sheet discharge direction abuts onto the abutting wall part 7, so that the sheet S is aligned in the sheet discharge direction DD.

An extension tray 12 is disposed in the stacking surface 6 in a storable manner, and it is possible to draw out the extension tray 12 in a direction along the stacking surface 6 with respect to the stacking surface 6. In a case where the discharged sheet is a relatively long sheet, it is possible to support the sheet with the stacking surface 6 and the extension tray 12 by drawing out the extension tray 12.

A discharge port 91 through which the sheet S discharged by the discharge roller pair 64 passes is formed in the abutting wall part 7, and the eaves cover 9 is disposed above the discharge port 91. By the eaves cover 9, it is possible to prevent infiltration of a foreign substance, such as dust, into an inside of the printer 100 from the discharge port 91, and also improve an exterior.

Further, the abutting wall part 7 includes a reference surface 7*a* extending along the vertical direction VD and a rib 11 provided on the reference surface 7*a* and extending downstream of the reference surface 7*a* in the sheet discharge direction DD. The rib 11, serving as an abutting part, is disposed upstream of the stacking surface 6 in the sheet discharge direction DD. It is preferred to dispose the rib 11 at equal to or more than two places in the width direction WD. The upstream edge of the sheet S stacked on the stacking surface 6 in the sheet discharge direction DD abuts against the rib 11.

A plurality of hole portions 10 are disposed in the reference surface 7*a* in directions parallel to the width direction WD and the vertical direction VD. The plurality of hole portions 10 are positioned below the discharge port 91. The plurality of hole portions 10 are disposed at positions, in the width direction WD, overlapping with an area through which the sheet S passes. That is, the plurality of hole portions 10 are disposed between one end and the other end of the discharge port 91 in the width direction WD. In this embodiment, the plurality of hole portions 10 include a first row 10L aligned along the width direction WD and a second row 10H, serving as an upper hole portion, aligned along the width direction WD and disposed above the first row 10L.

Layout of Holes

Figure 3:
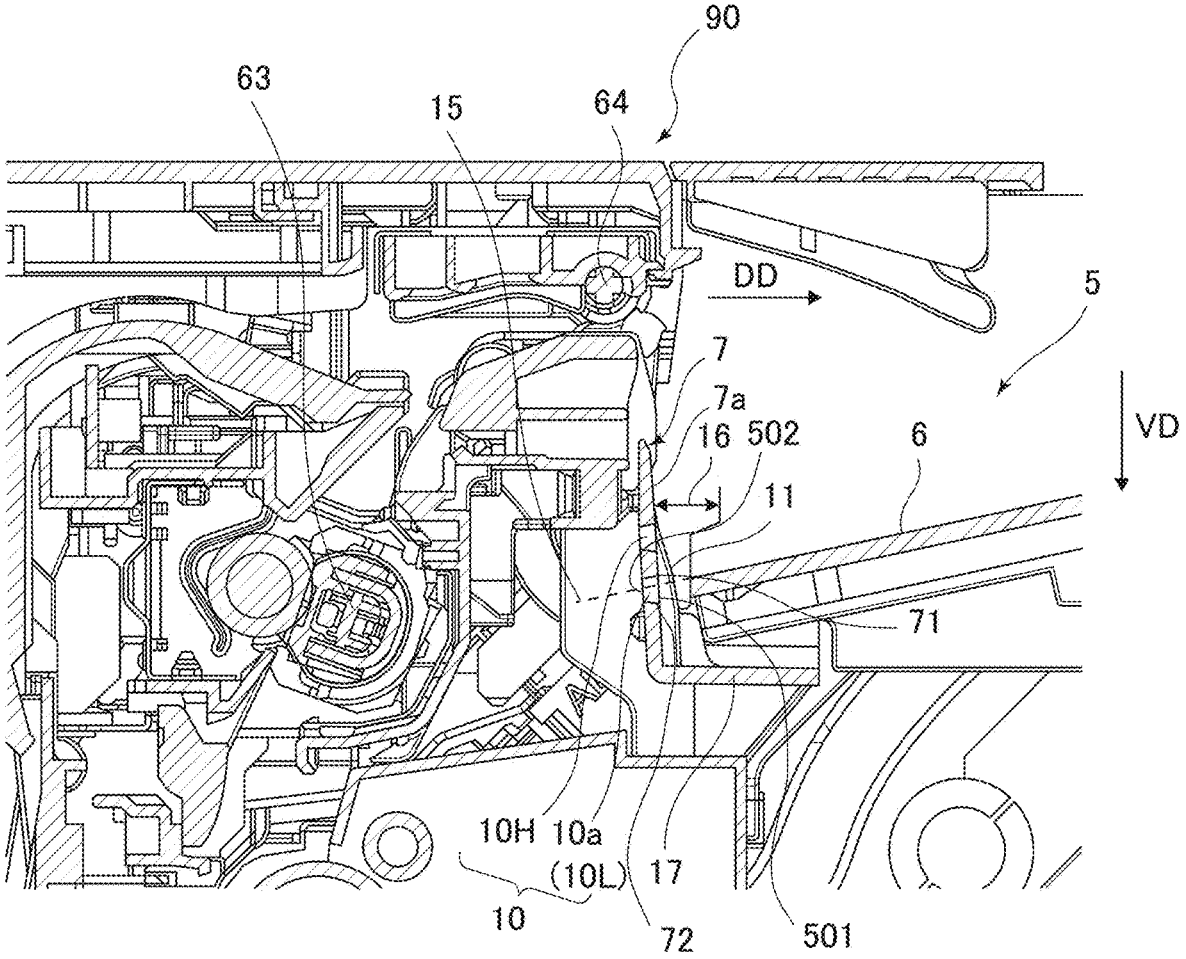
FIG. 3 is a cross-sectional view showing the sheet discharge apparatus.

Next, using FIG. 3, a layout of the plurality of hole portions 10 will be described. FIG. 3 is a cross-sectional view showing the sheet discharge apparatus 90, a hole portion which is one of the hole portions of the first row 10L is referred to as a first hole portion 10*a*. To be noted, each hole portion of the first row 10L is disposed at the same height. In other words, the first hole portions 10*a* are disposed at a plurality of places so as to be lined along the width direction WD (refer to FIG. 2).

As shown in FIG. 3, when viewed in the width direction WD, an extension line along the stacking surface 6 is referred to as an extension line 15. The first hole portion 10*a* is disposed across the extension line 15 in the vertical direction VD when viewed in the width direction WD. In other words, an upper end 71 of the first hole portion 10*a* is positioned above the extension line 15, and a lower end 72 of the first hole portion 10*a* is positioned below the extension line 15. In more particular, the first hole portion 10*a* includes a first edge portion 501 positioned on a side of the stacking surface 6 and communicated with an outside of the apparatus body 2 and a second edge portion 502 positioned opposite to the first edge portion 501 and communicated with an inside of the apparatus body 2. In this embodiment, in the vertical direction VD, the upper end 71 of the first hole portion 10*a* in the first edge portion 501 is positioned above the extension line 15, and the lower end 72 of the first hole portion 10*a* in the first edge portion 501 is positioned below the extension line 15. To be noted, it is acceptable if a relation between the extension line 15 and the first hole portion 10*a* described above is fulfilled at any one of edges of the first edge portion 501 and the second edge portion 502.

Further, in the sheet discharge direction DD, a gap 16 is disposed between the stacking surface 6 and the reference surface 7*a* of the abutting wall part 7. Further, a receiving surface 17, serving as a receiving portion, is disposed below the gap 16, and, for example, in a case where the foreign substance such as a water droplet infiltrates into the gap, it is possible to prevent the infiltration of the foreign substance into the inside of the printer 100 by receiving the foreign substance with the receiving surface 17.

Flow of Air

Figure 4:
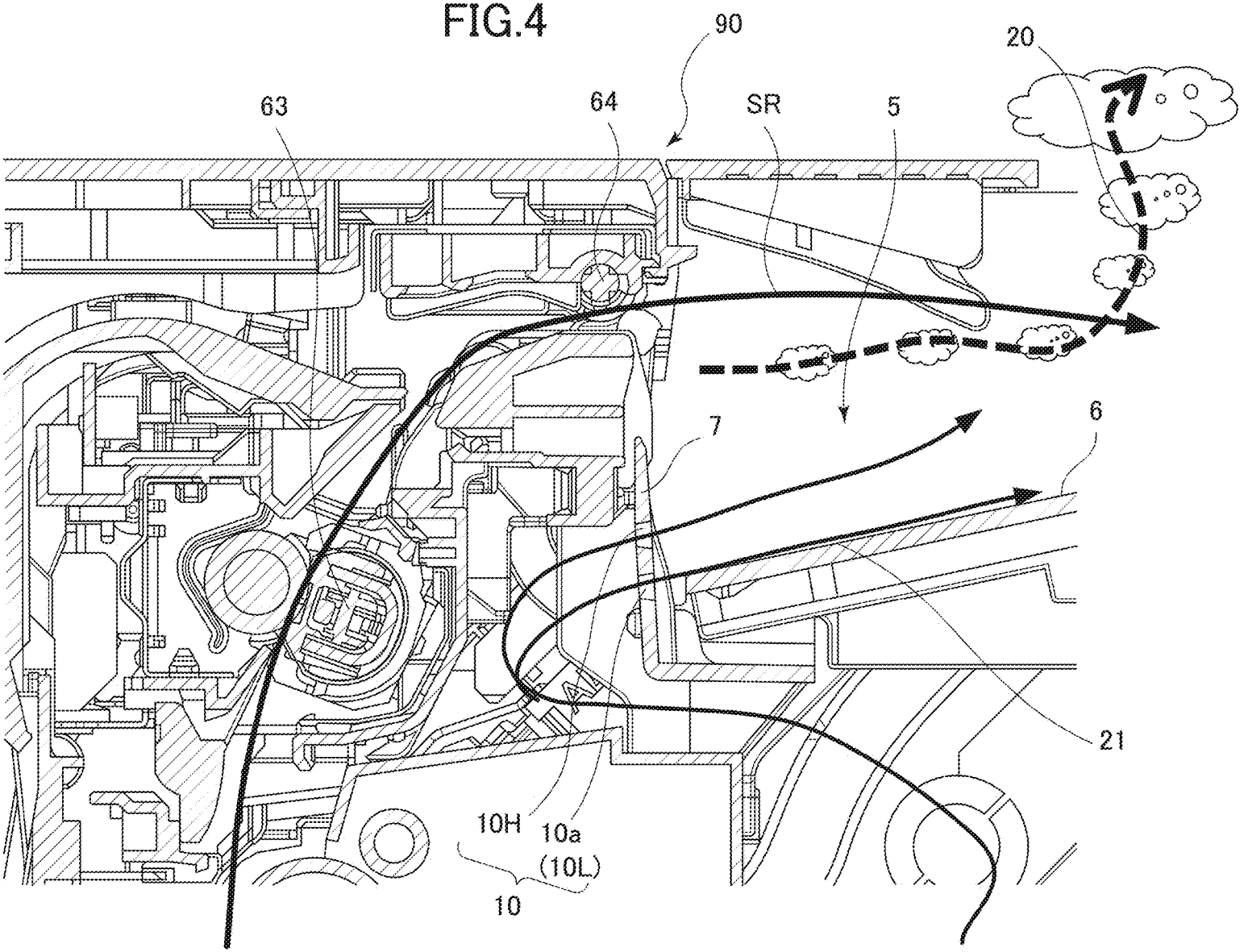
FIG. 4 is a cross-sectional view showing an air flow around the sheet discharge apparatus.

Next, using FIGS. 4 and 5, an air flow around the sheet discharge apparatus 90 will be described. As shown in FIG. 4, normally, the sheet S is conveyed along an arrow SR. At this time, the sheet S has been heated at the fixing unit 63, and the sheet S whose temperature has become high is discharged to the sheet stacking part 5 by the discharge roller pair 64.

Air around the sheet stacking part 5, which is warmed by heat of the sheet S, moves in a lateral direction (right hand side in FIG. 4) along with a conveyance movement of the sheet S, and the air flow shown by an arrow 20 is generated since the warmed air generates an ascending air current. Herewith, air pressure around the sheet stacking part 5 is lowered.

Fresh air 21 flows from the plurality of hole portions 10 disposed in the abutting wall part 7 into the sheet stacking part 5 which has become negative pressure as described above. As illustrated in FIG. 3, since the sheet stacking part 5 includes the first row 10L including the first hole portion 10*a* disposed in a manner straddling the extension line 15, the air especially flowing into the sheet stacking part 5 through the first row 10L flows along the stacking surface 6.

Figure 5:
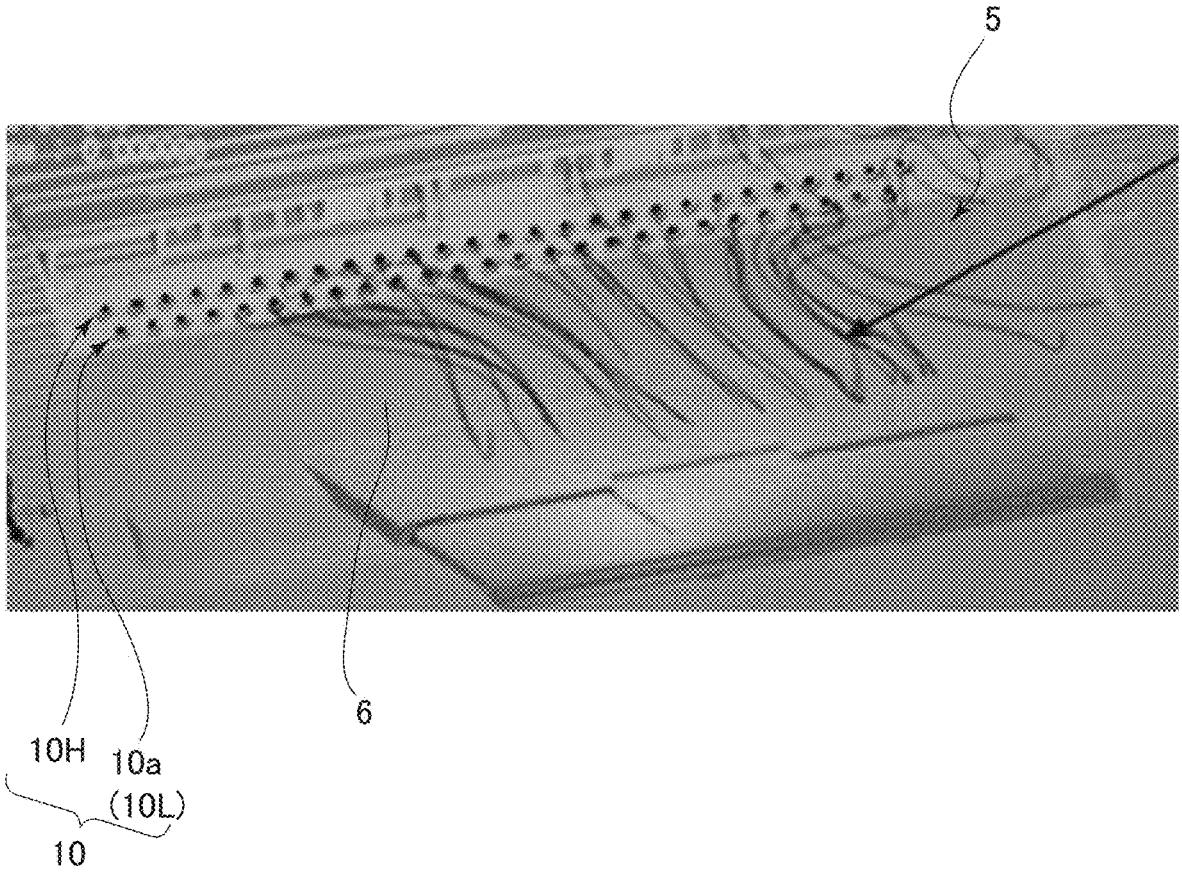
FIG. 5 is a perspective view showing the air flow according to a simulation.

FIG. 5 is a perspective view showing the air flow according to a simulation, but the sheet is not shown in FIG. 5. Further, it is confirmed from FIG. 5 that the air flowing into the sheet stacking part 5 through the plurality of hole portions 10 flows along the stacking surface 6. Herewith, even in a case where a relatively small quantity of the sheet S is stacked on the stacking surface 6, it is possible to securely apply a wind to the sheet S stacked on the stacking surface 6, and cool the sheet stably and efficiently.

Heat Insulating Configuration

Figure 6:
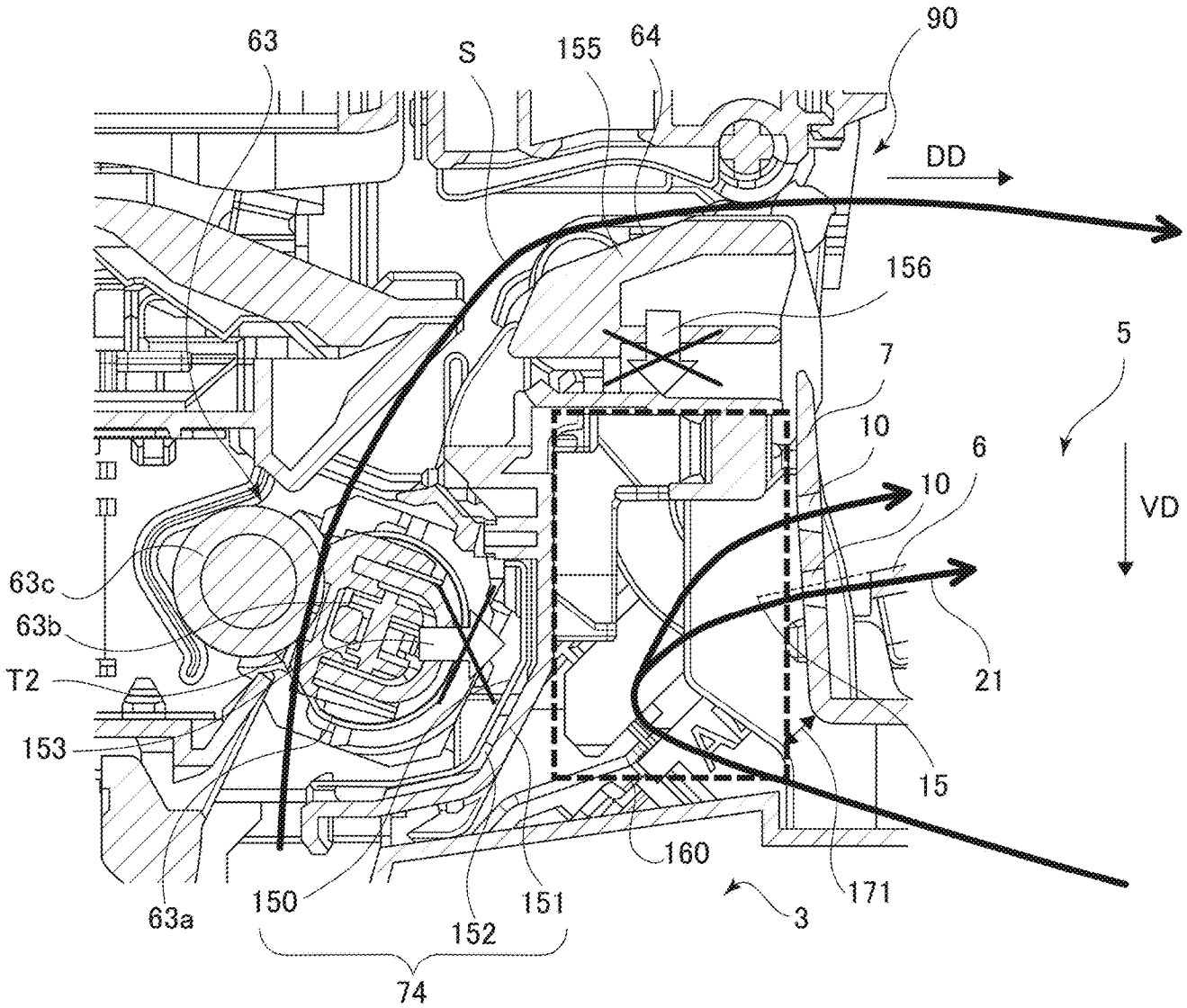
FIG. 6 is a cross-sectional view showing a heat insulating configuration of the printer.

Next, using FIG. 6, a heat insulating configuration of the printer 100 will be described. As shown in FIG. 6, the fixing unit 63 includes a tubular fixing rotary member 63*a* constituted by a belt, a film, and the like, a heating unit 63*b* disposed inside the fixing rotary member 63*a*, and a pressing roller 63*c* forming a fixing nip portion T2 with the fixing rotary member 63*a*. The heating unit 63*b* includes a heater, serving as a heating element, and the fixing nip portion T2 is heated by the heater.

Further, a heat insulating sheet metal 150 and a heat insulating resin cover 151 disposed along an outer peripheral surface of the fixing rotary member 63*a* are disposed between the fixing unit 63 and the abutting wall part 7 in the sheet discharge direction DD. The heat insulating sheet metal 150, serving as a first wall, is made of metal material, and the heat insulating resin cover 151, serving as a second wall, is made of resin material. The heat insulating resin cover 151 is disposed such that approximately 1 mm of an air layer is formed between the heat insulating resin cover 151 and the heat insulating sheet metal 150. These heat insulating sheet metal 150, the air layer 152, and the heat insulating resin cover 151 constitute a first heat insulating wall 74 extending in the vertical direction VD, and the first heat insulating wall 74 blocks the heat in an arrow 153 direction from the fixing unit 63.

A conveyance guide 155 is disposed between the abutting wall part 7 and the heat insulating resin cover 151 in the sheet discharge direction DD, and extends along the sheet discharge direction DD. The abutting wall part 7 and the heat insulating resin cover 151 are coupled by the conveyance guide 155 with gaps as little as possible. The conveyance guide 155 consists of resin material. Herewith, heat transmitted from the sheet passing through above the conveyance guide 155 in an arrow 156 direction is effectively blocked by the conveyance guide 155, serving as a second heat insulating wall.

Herewith, it is possible to suppress heating of air in an area 160, indicated by a broken line, positioned between the conveyance guide 155 and the image forming unit 3 in the vertical direction VD. Since the air passing through the plurality of hole portions 10 mainly passes through the area 160, it is possible to improve colling efficiency of the sheet S by maintaining the area 160 under a low temperature environment.

Figure 7:
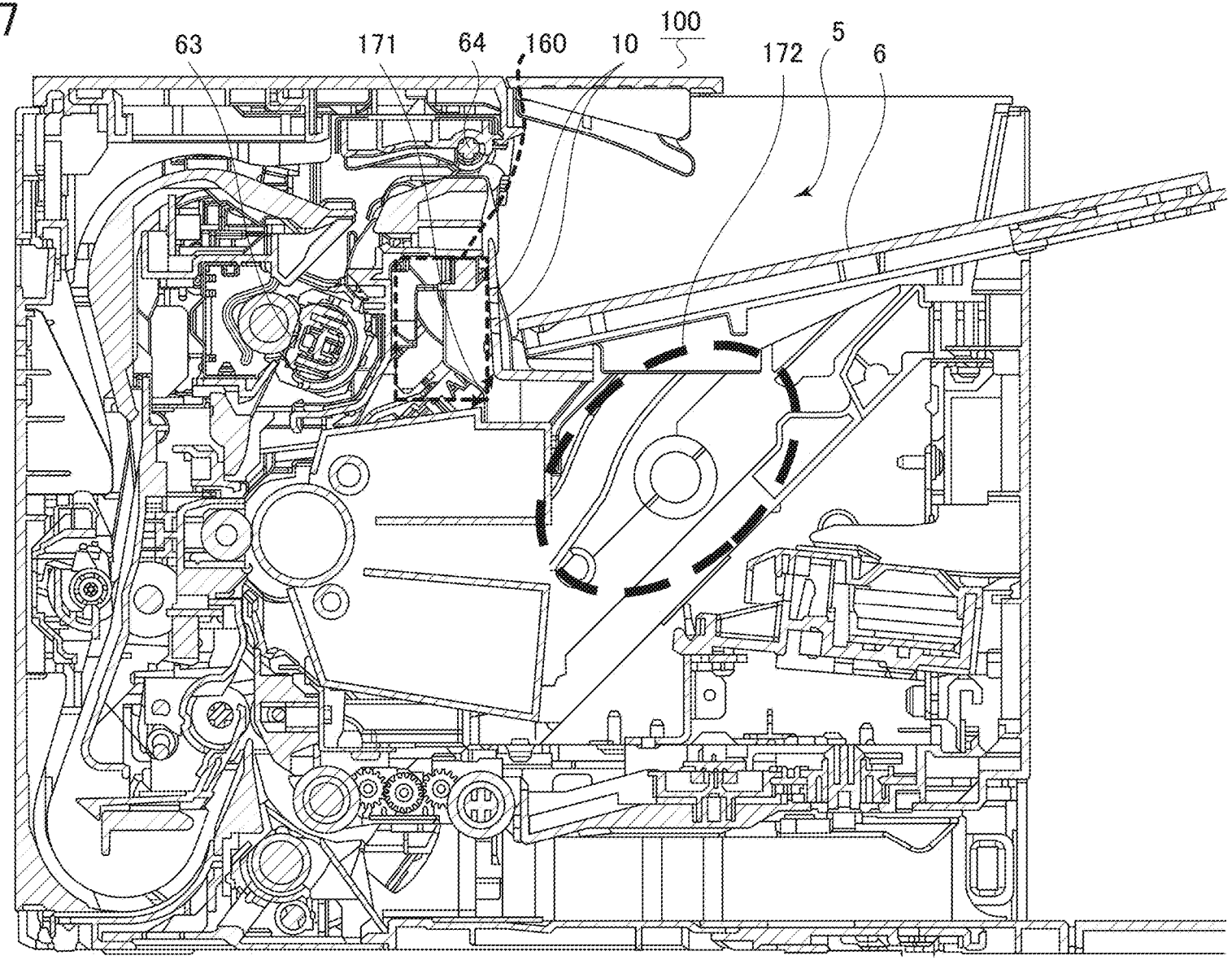
FIG. 7 is a cross-sectional view showing an internal structure of the printer.

FIG. 7 is a cross-sectional view showing an internal structure of the printer 100 of this embodiment. The printer 100 takes in the air from an inflow path, not shown, into the inside, and stores the unwarmed fresh air in an area 172. Then, since the area 172 and the area 160 are infallibly communicated with each other by securing a gap 171, the air passed through the area 172 and the area 160 flows from the plurality of hole portions 10 into the sheet stacking part 5.

As described above, in this embodiment, since the plurality of hole portions 10 including the first hole portion 10*a* (and the first row 10L) disposed so as to straddle the extension line 15 is disposed in the abutting wall part 7, it is possible to flow the cooling air along the stacking surface 6. Herewith, for example, even in the case where the small quantity of the sheet is stacked on the stacking surface 6, it is possible to improve the cooling efficiency and suppress the sheet to stick to each other.

Especially, in recent years, a printing speed is accelerated, and also there is a tendency to use a low melting point type toner whose melting point is relatively low. In a case where the low melting point type toner is used, there is a risk of the sheet to stick to each other even in a low-end type printer in which the printing speed is relatively slow. Therefore, a demand for the improvement in the cooling efficiency of the discharged sheet is further increased. Further, although a disposition of a fan in the printer so as to generate the cooling air to cool the sheet is also considered, it is preferred not to dispose the fan in view of, for example, miniaturization of the apparatus, a cost reduction, and a noise reduction. To be noted, while the fan is not disposed in the printer 100 in this embodiment, it is acceptable to dispose the fan.

At this point, a case where the stacking surface 6 and the abutting wall part 7 are disposed without a gap in between in the sheet discharge direction DD is examined. In this case, since the first hole portion 10*a* is disposed so as to straddle the extension line 15, the foreign substance such as the water droplet sliding along the stacking surface 6 infiltrates into the inside of the printer 100 from the first hole portion 10*a*. Therefore, in this embodiment, the gap 16 is disposed between the stacking surface 6 and the reference surface 7*a* of the abutting wall part 7 in the sheet discharge direction DD. Further, the receiving surface 17 is disposed below the gap 16. Herewith, it is possible to prevent the foreign substance such as the water droplet from infiltrating into the inside of the apparatus from the first hole portion 10*a*.

Further, the abutting wall part 7 includes the reference surface 7*a*, in which the plurality of hole portions 10 are formed, and the rib 11 abutting onto the upstream edge of the sheet. Therefore, since a gap is formed by the rib 11 between the upstream edge of the sheet and the plurality of hole portions 10, it is possible to prevent the sheet S from blocking the plurality of hole portions 10. Herewith, it is possible to maintain the cooling efficiency of the sheet well.

Further, the sheet discharge apparatus 90 defines the area 160, serving as the passing area, by the first insulating wall 74, the conveyance guide 155, and the abutting wall part 7. Although the air infiltrating into the sheet stacking part 5 through the plurality of hole portions 10 passes through the area 160, since the area 160 is thermally insulated by the first insulating wall 74 and the conveyance guide 155, it is possible to improve the cooling efficiency of the sheet.

To be noted, in this embodiment, it is acceptable to dispose a duct which further clarifies the outside air inflow port. Further, although the stacking surface 6 has a linear plane shape, a shape of the stacking surface 6 is not limited to the plane shape. For example, when viewed in the width direction WD, it is acceptable to form the stacking surface 6 in a curved surface shape, and, in this case, the extension line 15 becomes a line aligned with the curved surface shape of the stacking surface 6. In more particular, the extension line 15 is a tangential line of the stacking surface 6 at the upstream edge of the stacking surface 6 in the sheet discharge direction DD. In other words, the extension line 15 is the tangential line of the stacking surface 6, and comes into contact with the stacking surface 6 at the upstream edge of the stacking surface 6 in the sheet discharge direction DD. In this embodiment, since the stacking surface 6 has the plane shape, the extension line 15 is parallel to the stacking surface 6, and passes through the upstream edge of the stacking surface 6 in the sheet discharge direction DD.

Second Embodiment

While a second embodiment of this disclosure will be described next, the configuration of the plurality of hole portions of the first embodiment is changed in the second embodiment. Therefore, regarding configurations similar to the first embodiment, illustrations will be omitted herein, and descriptions will be provided by putting the same marks in drawings.

Figure 8:
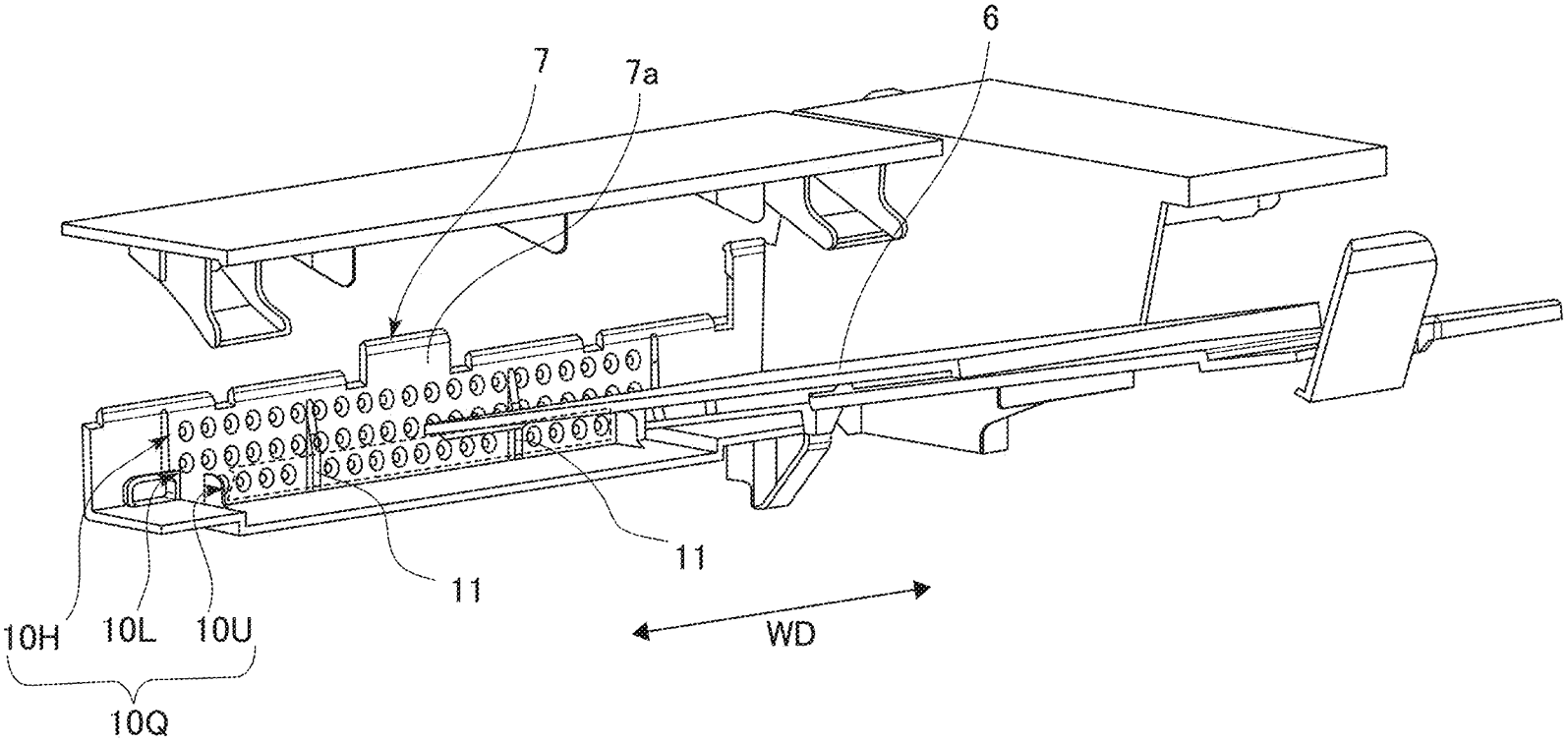
FIG. 8 is a perspective view showing a plurality of hole portions according to a second embodiment.

As shown in FIG. 8, a plurality of hole portions 10Q of the second embodiment includes the first row 10L, the second row 10H, and a third row 10U. The third row 10U is aligned along the width direction WD, and disposed below the first row 10L.

Figure 9:
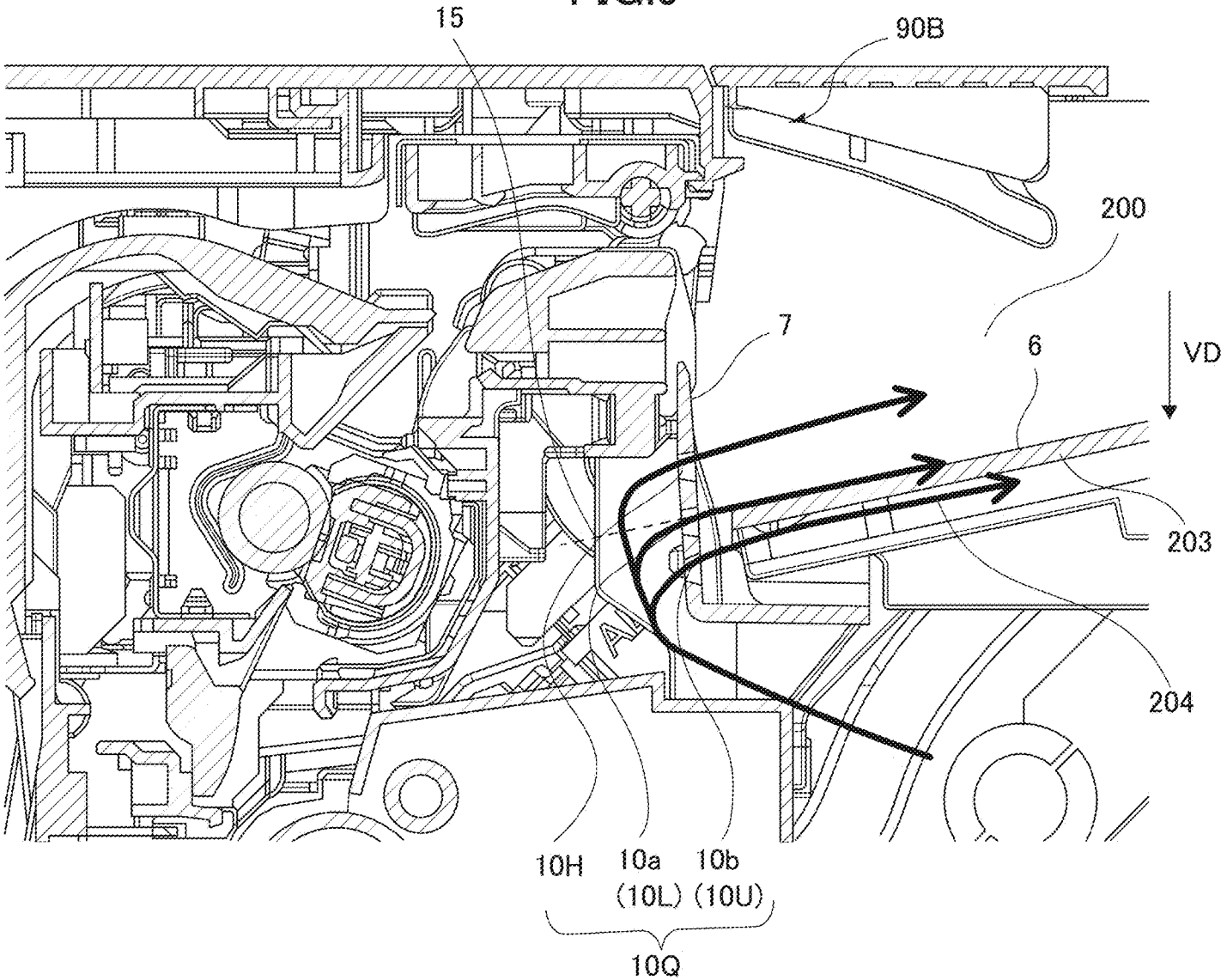
FIG. 9 is a cross-sectional view showing a sheet discharge apparatus.

FIG. 9 is a cross-sectional view showing a sheet discharge apparatus 90B of the second embodiment, and one of the hole portion of the third row 10U is referred to as a second hole portion 10*b*. To be noted, each hole portion of the third row 10U is disposed at the same height in the vertical direction VD. The second hole portion 10*b* is, as shown in FIG. 9, disposed below the first hole 10*a* and the extension line 15 of the stacking surface 6, and disposed at a position corresponding to a back surface 203 of the stacking surface 6.

Therefore, the air passed through the second hole portion 10*b* flows along the back surface 203 of the stacking surface 6. This flow of the air is expressed by a flow line 204. Therefore, since it is possible to cool the stacking surface 6 from a front side and a back side, it is possible to improve the cooling efficiency of the sheet.

Third Embodiment

While a third embodiment of this disclosure will be described next, the configuration of the stacking surface of the first embodiment is changed in the third embodiment. Therefore, regarding configurations similar to the first embodiment, illustrations will be omitted herein, and descriptions will be provided by putting the same marks in drawings.

Figure 10:
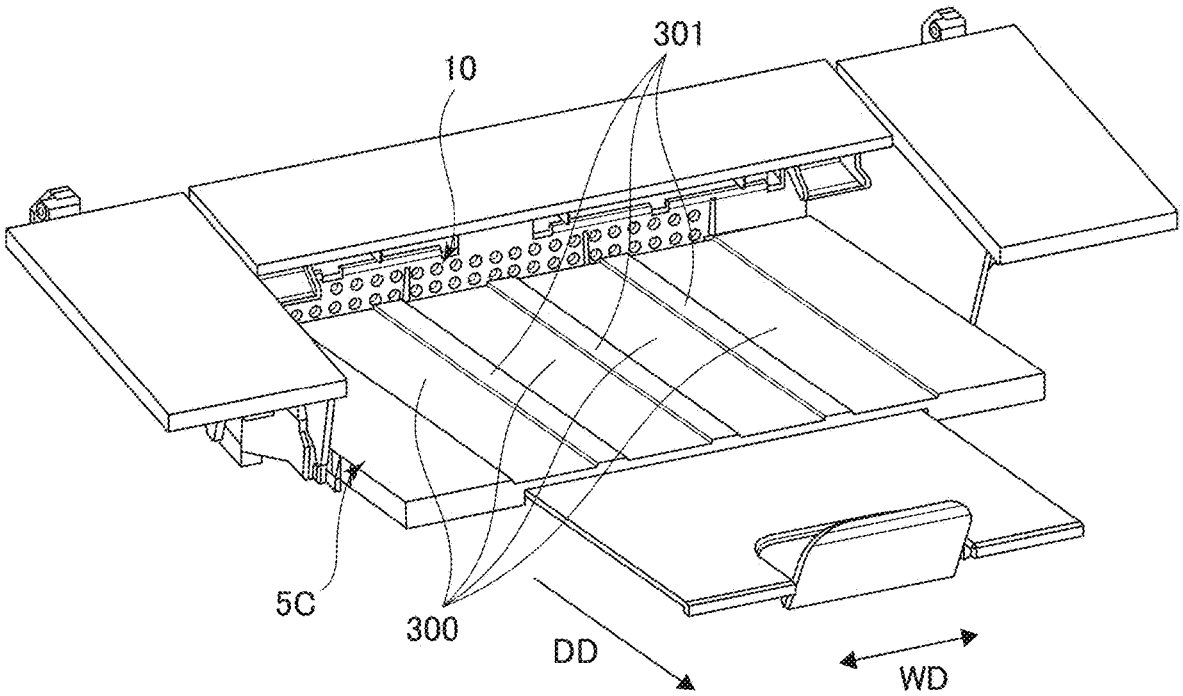
FIG. 10 is a perspective view showing a stacking surface according to a third embodiment.

A stacking surface 5C of the third embodiment includes, as shown in FIG. 10, a plane 301 and a plurality of grooves 300 recessed downwards from the plane 301 and extending along the sheet discharge direction. The groove 300 is recessed downwards by approximately 1 mm from the plane 301. To be noted, the layout of the plurality of hole portions 10 is not changed from the first embodiment.

Herewith, since a gap is formed under the sheet stacked on the plane 301 of the stacking surface 5C by the groove 300, it is possible for the air to pass through the gap. Herewith, since the air passed through the plurality of hole portions 10 flows along front and back surfaces of the sheet stacked on the stacking surface 5C, it is possible to improve the cooling efficiency of the sheet. To be noted, regarding a width of the plane 301 in the width direction WD, the improvement in the cooling efficiency of the sheet becomes larger the narrower the width is set.

Fourth Embodiment

While a fourth embodiment of this disclosure will be described next, the configuration of the plurality of hole portions of the first embodiment is changed in the fourth embodiment. Therefore, regarding configurations similar to the first embodiment, illustrations will be omitted herein, and descriptions will be provided by putting the same marks in drawings.

Figure 11:
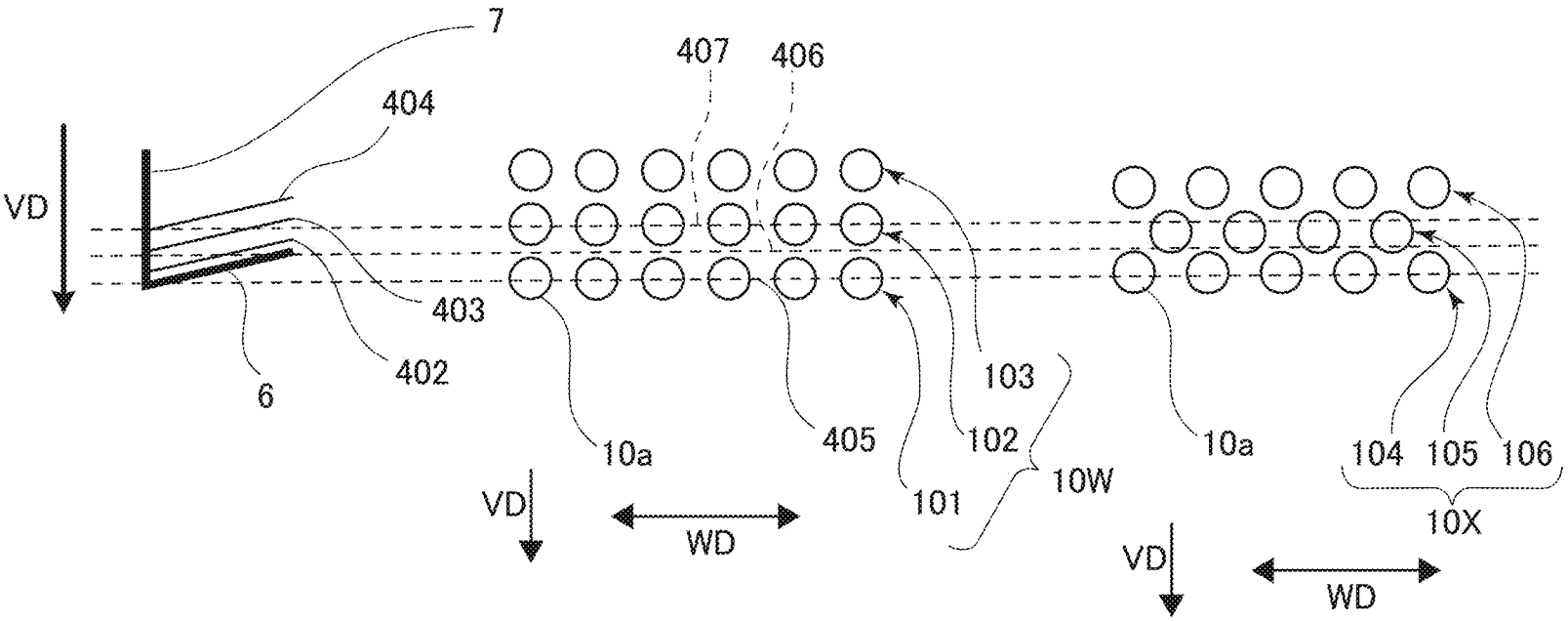
FIG. 11 is a diagram illustrating a plurality of hole portions according to a fourth embodiment.

FIG. 11 is a drawing illustrating a plurality of hole portions 10X of the fourth embodiment. A drawing disposed on the left hand side of FIG. 11 is a schematic view showing a first sheet 402, a second sheet 403, and a third sheet 404 stacked on the stacking surface 6. A drawing disposed in the center of FIG. 11 shows a plurality of hole portions 10W lined in an orthogonally aligned pattern in accordance with a comparative example, and a drawing disposed on the right hand side of FIG. 11 shows the plurality of hole portions 10X lined in a pattern in accordance with the fourth embodiment.

As shown in the drawing disposed in the center of FIG. 11, the plurality of hole portions 10W lined in the orthogonally aligned pattern in accordance with the comparative example includes a first row 101, a second row 102, and a third row 103 each aligned in the width direction WD. Each hole portion of the first row 101, the second row 102, and the third row 103 is also aligned in the vertical direction VD, and does not overlap each other in the vertical direction VD. That is, in the vertical direction VD, an upper end of the first row 101 is separated from a lower end of the second row 102, and an upper end of the second row 102 is separated from a lower end of the third row 103. To be noted, the first column 101 includes the plurality of first hole portions 10*a*.

As shown in the diagram disposed on the right hand side of FIG. 11, the plurality of hole portions 10X lined in the pattern in accordance with the fourth embodiment includes a fourth row 104, a fifth row 105, and a sixth row 106 each including a plurality of holes aligned in the width direction WD. The fourth row 104, the fifth row 105, and the sixth row 106 respectively constitute a first row, a second row, and a third row. In other words, the plurality of hole portions 10X includes the plurality of rows of hole portions lined in the vertical direction VD, and each of the plurality of rows of hole portions includes the plurality of holes aligned along the width direction WD. Each hole portion of the fourth row 104 and the sixth row 106 is aligned also in the vertical direction VD. Each hole portion of the fifth row 105 is out of alignment in the width direction WD with respect to each hole portion of the fourth row 104 and the sixth row 106. In the width direction WD, each hole portion of the fifth row 105 is positioned between each hole portion of the fourth row 104 and the sixth row 106.

Further, the fifth row 105, in the vertical direction VD, overlaps with the fourth row 104 and the sixth row 106. That is, in the vertical direction VD, an upper end of the fourth row 104 is positioned at the same position as a lower end of the fifth row 105, or positioned above the lower end of the fifth row 105. Further, an upper end of the fifth row 105 is positioned at the same position as a lower end of the sixth row 106, or positioned above the lower end of the sixth row 106. To be noted, the fourth row 104 includes the plurality of first hole portions 10*a*.

As shown in the diagram disposed on the left hand side of FIG. 11, a line 405 is a line passing through an intersection point of the stacking surface 6 with the abutting wall part 7, and parallel to a horizontal direction. A line 406 is a line passing through an intersection point of the second sheet 403 with the abutting wall part 7, and parallel to the horizontal direction. A line 407 is a line passing through an intersection point of the third sheet 404 with the abutting wall part 7, and parallel to the horizontal direction.

As shown in FIG. 11, the line 405 extends so as to straddle the first row 101 and the fourth row 104, and the line 407 extends so as to straddle the second row 102 and the fifth row 105. On the other hand, the line 406 passes through between the first row 101 and the fourth row 104, and extends so as to straddle the fourth row 104 and the fifth row 105.

As described above, since there is a little gap between the rows in the vertical direction VD in the plurality of hole portions 10W lined in the orthogonally aligned pattern shown in the diagram disposed in the center of FIG. 11, there is a portion, in the vertical direction VD, at which the flow of the cooling air is broken. On the other hand, since adjacent rows in the vertical direction VD overlap each other in the vertical direction VD in the plurality of hole portions 10X lined in the pattern shown in the diagram disposed on the right hand side of FIG. 11, there is not a portion, in the vertical direction VD, at which the flow of the cooling air is broken. Therefore, it is possible to cool the sheet more efficiently.

Other Embodiments

To be noted, it is preferred that the plurality of hole portions described above consist of a hole portion whose maximum opening size is equal to or less than 5 mm. In each of the embodiments described above, the hole portion has a circular shape with a diameter of approximately 3 mm.

To be noted, in any of the embodiments described above, it is acceptable to dispose equal to or more than three rows or one row for the plurality of hole portions. Further, each hole portion is not limited to a round hole, and a polygonal hole portion is acceptable. Further, a long hole which is long in the vertical direction VD is also acceptable. Further, it is acceptable that the plurality of hole portions do not include equal to or more than two hole portions in each row.

Further, while, in any of the embodiments described above, the rib 11 is disposed in the abutting wall part 7, it is acceptable to omit the rib 11. That is, using the reference surface 7*a* as an abutting part, it is acceptable to configure in such a manner that the upstream edge of the sheet S abuts onto the reference surface 7*a*. Further, it is acceptable to omit the gap 16 between the abutting wall part 7 and the stacking surface 6. Further, it is acceptable to arbitrarily combine any of the embodiments described above with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-129497, filed Jul. 30, 2020, and Japanese Patent Application No. 2021-090931, filed May 31, 2021, which are hereby incorporated by reference herein in their entireties.

What is claimed is:

1. A sheet discharge apparatus comprising:

a discharge unit configured to discharge a sheet in a discharge direction;

a stacking surface configured to stack the sheet discharged by the discharge unit; and a wall comprising a plurality of hole portions and an abutting part against which an upstream edge, in the discharge direction, of the sheet stacked on the stacking surface abuts, the abutting part being disposed upstream of the stacking surface in the discharge direction, wherein the plurality of hole portions comprises a first hole portion disposed across an extension line along the stacking surface when viewed in a width direction orthogonal to the discharge direction and a vertical direction, the first hole portion comprising a first edge portion and a second edge portion opposite to the first edge portion, the first edge portion being positioned on a side of the stacking surface, and wherein, in the vertical direction, an upper end of the first edge portion of the first hole portion is positioned above the extension line, and a lower end of the first edge portion of the first hole portion is positioned below the extension line.

2. The sheet discharge apparatus according to claim 1, wherein a gap is disposed between the stacking surface and the wall in the discharge direction.

3. The sheet discharge apparatus according to claim 2, further comprising a receiving portion disposed under the gap.

4. The sheet discharge apparatus according to claim 1, wherein the wall comprises a reference surface extending in the vertical direction, the reference surface being a surface in which the plurality of hole portions are formed, and wherein the abutting part comprises a rib which is provided on the reference surface, which extends downstream of the reference surface in the discharge direction, and against which the upstream edge of the sheet stacked on the stacking surface abuts.

5. The sheet discharge apparatus according to claim 1, wherein the plurality of hole portions comprises the first hole portion and a second hole portion, the second hole portion being disposed below the extension line.

6. The sheet discharge apparatus according to claim 1, wherein the plurality of hole portions comprises an upper hole portion disposed above the first hole portion.

7. The sheet discharge apparatus according to claim 1, wherein the stacking surface comprises a groove extending along the discharge direction.

8. The sheet discharge apparatus according to claim 1, wherein the plurality of hole portions comprises a plurality of rows of hole portions lined in the vertical direction when viewed in the discharge direction, each of the plurality of rows of hole portions comprising a plurality of holes aligned along the width direction, and wherein adjacent rows of the plurality of rows of hole portions in the vertical direction are configured to overlap each other in the vertical direction.

9. The sheet discharge apparatus according to claim 1, wherein the plurality of hole portions, when viewed in the discharge direction, comprises a first row comprising a plurality of holes lined in the width direction, a second row comprising a plurality of holes lined in the width direction and positioned above the first row, and a third row comprising a plurality of holes lined in the width direction and positioned above the second row, and wherein the second row is configured to overlap with the first row and the third row in the vertical direction.

10. The sheet discharge apparatus according to claim 1, wherein the abutting part is configured to regulate a movement of the sheet in a case where the sheet stacked on the stacking surface has moved toward the wall.

11. The sheet discharge apparatus according to claim 10, wherein the stacking surface is inclined so as to move the sheet stacked on the stacking surface toward the wall.

12. The sheet discharge apparatus according to claim 1, further comprising an apparatus body, wherein the discharge unit is configured to discharge the sheet from an inside of the apparatus body to an outside of the apparatus body, and wherein the first edge portion communicates with the outside of the apparatus body, and the second edge portion communicates with the inside of the apparatus body.

13. An image forming apparatus comprising:

a transfer portion configured to transfer a toner image onto a sheet;

a fixing unit configured to fix the toner image transferred by the transfer portion on the sheet; and the sheet discharge apparatus according to claim 1 configured to discharge the sheet passed through the fixing unit.

14. The image forming apparatus according to claim 13, further comprising a first heat insulating wall disposed between the fixing unit and the wall in the discharge direction and extending along the vertical direction; and a second heat insulating wall extending in the discharge direction and disposed between the first heat insulating wall and the wall in the discharge direction, wherein a passing area is defined by the first heat insulating wall, the second heat insulating wall, and the wall, the passing area being an area through which air flowing toward the plurality of hole portions passes, wherein the first heat insulating wall comprises a first wall made of metal material and a second wall made of resin material and disposed such that an air layer is formed between the first wall and the second wall, and wherein the second heat insulating wall is made of resin material.

* * * * *